US009140061B2

(12) United States Patent
Cha

(10) Patent No.: US 9,140,061 B2
(45) Date of Patent: Sep. 22, 2015

(54) VERTICAL BLIND UNITED BY WEAVING AND FABRICATING METHOD THEREOF

(76) Inventor: Ki Cheol Cha, Dalseo-gu (KR)

( * ) Notice: Subject to any disclaimer, the term of this patent is extended or adjusted under 35 U.S.C. 154(b) by 705 days.

(21) Appl. No.: 12/988,930

(22) PCT Filed: Apr. 29, 2009

(86) PCT No.: PCT/KR2009/002246

§ 371 (c)(1),
(2), (4) Date: Oct. 21, 2010

(87) PCT Pub. No.: WO2009/136703

PCT Pub. Date: Nov. 12, 2009

(65) Prior Publication Data

US 2011/0036514 A1 Feb. 17, 2011

(30) Foreign Application Priority Data

May 9, 2008 (KR) ..... 10-2008-0043376

(51) Int. Cl.

| | |
|---|---|
| ***E06B 9/36*** | (2006.01) |
| ***A47H 1/00*** | (2006.01) |
| ***E06B 3/32*** | (2006.01) |
| *E06B 9/24* | (2006.01) |

(52) U.S. Cl.
CPC ..... *E06B 9/36* (2013.01); *E06B 2009/2429* (2013.01)

(58) Field of Classification Search
CPC ..... D03D 15/00; D03D 9/00; D03D 1/08; E06B 2009/2429; E06B 2009/2423; E06B 9/264
USPC ..... 139/384 A; 160/168.1 V, 173 V, 177 V, 160/348, 900
See application file for complete search history.

(56) References Cited

U.S. PATENT DOCUMENTS

| | | | | |
|---|---|---|---|---|
| 5,101,876 | A * | 4/1992 | Zak | 160/236 |
| 5,642,633 | A * | 7/1997 | Pedall | 66/193 |
| 5,937,927 | A * | 8/1999 | Keith | 160/89 |
| 7,404,429 | B2 * | 7/2008 | Graichen | 160/89 |
| 2005/0211392 | A1 * | 9/2005 | Elembaby | 160/89 |
| 2006/0237147 | A1 * | 10/2006 | Strand et al. | 160/89 |
| 2009/0139664 | A1 * | 6/2009 | Graichen | 160/84.04 |
| 2010/0139873 | A1 * | 6/2010 | Gardner | 160/84.04 |

FOREIGN PATENT DOCUMENTS

| | | |
|---|---|---|
| JP | 3563621 | 9/2004 |
| KR | 20-0261897 | 1/2002 |
| KR | 20-0419208 | 6/2006 |
| KR | 20-0428531 | 10/2006 |
| WO | WO-96/35854 | 11/1996 |

* cited by examiner

*Primary Examiner* — Katherine Mitchell
*Assistant Examiner* — Jeremy Ramsey
(74) *Attorney, Agent, or Firm* — Jordan and Hamburg LLP

(57) ABSTRACT

A vertical blind united by weaving and a method of fabricating the same are disclosed, wherein a plurality of fabric louvers 20 each having a constant width are arranged at a regular interval in one surface of a curtain section 10 having a predetermined area resulting from a mesh structure, the curtain section 10 is united with the fabric louvers 20 by weaving along longitudinal edges of the fabric louvers 20, and upper ends of the fabric louvers 20 are applied to a typical vertical blind structure, so that lighting is adjusted by rotation of the fabric louvers and air ventilation through the curtain section 10 is facilitated.

2 Claims, 16 Drawing Sheets

( a )

( b )

( a )

( b )

(a)

(b)

(c)

VERTICAL BLIND UNITED BY WEAVING AND FABRICATING METHOD THEREOF

TECHNICAL FIELD

The present invention relates to a vertical blind united by weaving and a method of fabricating the same, wherein a plurality of fabric louvers each having a constant width are arranged at a regular interval in one surface of a curtain section having a predetermined area resulting from a mesh structure, the curtain section is united with the fabric louvers by weaving along longitudinal edges of the fabric louvers, and upper ends of the fabric louvers are applied to a typical vertical blind structure, so that lighting is adjusted by rotation of the fabric louvers and air ventilation through the curtain section is facilitated.

BACKGROUND ART

In general, curtains and blinds are installed on windows or doorways of buildings and are used for blocking solar light, external sight, noise and cold, and are also used as an important factor of indoor decoration for enhancing the indoor beauty in accordance with combination of colors that can be harmonized with indoor walls or glasses.

By way of example, among various blinds, a vertical blind has a plurality of louvers with a panel shape that are arranged at a regular interval along its longitudinal direction to adjust lighting by means of rotation of the louver, wherein each louver is fixed to a carrier movable along a rail, the carrier has a housing movable along the rail and a louver ring capable of rotating below the housing, the louver is fixed to the louver ring, and the vertical blind has two adjustment strings, and one of which acts to rotate the louver up to 180 degrees and the other acts to move the louvers along the rail in one direction or both directions.

Accordingly, the typical blind blocks light when all louvers are rotated to form a plane on the whole by the adjustment string, and allows light to be taken in when the louvers are rotated by 90 degrees and then are slid to move in one direction or both directions after light is blocked.

[Document 1] Korean Utility Model Registration No. 20-0261897

According to the document 1, a vertical blind is disclosed which can also be used as a curtain, which has a clip fixed to an upper end of the vertical blind and coupled to each traveler that can be folded and rotated forward by the operation of a driving unit disposed at one side of the rail, wherein blinds are adhered and fixed to both sides of a curtain band with a constant width and a constant length to form curtain bands, the curtain blinds are vertically arranged while a pair of adjacent blinds are disposed to be in contact with each other to make the curtain bands in contact with each other, and upper and lower ends of the a pair of blinds are coupled to upper clips having typical hanger pieces and separate lower clips.

In the general vertical blind, it is difficult to carry out ventilation when light is blocked by the louver, and air may be taken in by the vertical blind structure but light may also be taken in when light is not blocked, so that smooth air ventilation can not be carried out while blocking sunlight.

In addition, as disclosed in the document 1, the curtain bands are coupled to the blinds to implement the vertical blind that can also be used as the curtain, however, the curtain band also acting as the curtain makes it difficult to take in air, many components such as upper and lower clips are required on upper and lower ends to connect the blinds, a unit price is high due to human resources and time required for fabrication and assembly, and the curtain bands and the blinds are formed of different materials each other so that the aesthetic property of the vertical blind is not good.

DISCLOSURE

Technical Problem

The present invention is directed to a vertical blind united by weaving and a method of fabricating the same.

Technical Solution

One aspect of the present invention is to provide a vertical blind united by weaving, which includes a curtain section and fabric louvers woven with repeating cutting sections, wherein a plurality of fabric louvers each having a constant width are arranged at a regular interval in one surface of a curtain section having a predetermined area resulting from a mesh structure, the curtain section is united with the fabric louvers by weaving along longitudinal edges of the fabric louvers, and upper ends of the fabric louvers are applied to a typical vertical blind structure, so that lighting is adjusted by rotation of the fabric louvers and air ventilation through the curtain section is facilitated.

In addition, one side of the fabric louver is fixed to a curtain section and the other side thereof is opened, and the curtain section and the fabric louvers are woven to form united sections. In particular, the curtain section and the fabric louver between the united sections are simultaneously woven with a constant width by supplied warps and woofs, the curtain section of a constant width is woven by the supplied warps and woofs, woofs are not supplied to the fabric louvers to make warps opened, which results in repeating woven cutting sections of constant width to form the blind sections, and the blind sections woven by the method noted above allow the opened warps of the cutting sections to be removed by a shearing machine so that one end of the fabric louver is fixed to the curtain section by the united section and the other end thereof is opened due to the removed warps.

In addition, the fabric louver has a cross-sectional structure as shown in FIG. 16A, and a panel-type slat is put into the fabric louver to maintain shape and durability of the fabric louver.

In addition, a low-melting fiber is used as the woof for forming the curtain section and the fabric louver, and the blind sections are directed to pass through a tenter to melt the low-melting fiber so that the shape of the blind section can be maintained.

The blind section has a pattern of 12 repeating warps, which are repeatedly woven per three fabric louvers, so that the blind section can be easily woven and the structure of the blind section can be easily formed.

In addition, a rubber thread is interlaced with woofs of the curtain section and the united section to prevent folds from occurring in the blind section.

In addition, a flame retardant thread subjected to flame retardant processing is employed as the warp and woof for weaving the blind section, or the woven blind section is subjected to flame retardant processing to make the woven vertical blind safe against fire.

In addition, after the blind sections are assembled, the curtain section adjacent to and coupled to the fabric louvers is folded and backstitched to make the curtain section with a smooth arc, thereby enhancing an aesthetic property of the blind.

Advantageous Effects

According to the present invention, a vertical blind united by weaving is provided, which includes a curtain section and fabric louvers woven with repeating cutting sections, wherein a plurality of fabric louvers each having a constant width are arranged at a regular interval in one surface of a curtain section having a predetermined area resulting from a mesh structure, the curtain section is united with the fabric louvers by weaving along longitudinal edges of the fabric louvers, and upper ends of the fabric louvers are applied to a typical vertical blind structure, so that lighting is adjusted by rotation of the fabric louvers and air ventilation through the curtain section is facilitated.

In addition, one side of the fabric louver is fixed to a curtain section and the other side thereof is opened, and the curtain section and the fabric louvers are woven to form united sections. In particular, the curtain section and the fabric louver between the united sections are simultaneously woven with a constant width by supplied warps and woofs, the curtain section of a constant width is woven by the supplied warps and woofs, woofs are not supplied to the fabric louvers to make warps opened, which results in repeating woven cutting sections of constant width to form the blind sections, and the blind sections woven by the method noted above allow the opened warps of the cutting sections to be removed by a shearing machine so that one end of the fabric louver is fixed to the curtain section by the united section and the other end thereof is opened due to the removed warps, thereby facilitating opening the fabric louver.

In addition, the fabric louver has a cross-sectional structure as shown in FIG. 16A, and a panel-type slat is put into the fabric louver to maintain shape and durability of the fabric louver.

In addition, a low-melting fiber is used as the woof for forming the curtain section and the fabric louver, and the blind sections are directed to pass through a tenter to melt the low-melting fiber so that the shape of the blind section can be maintained.

The blind section has a pattern of 12 repeating warps, which are repeatedly woven per three fabric louvers, so that the blind section can be easily woven and the structure of the blind section can be easily formed.

In addition, a rubber thread is interlaced with woofs of the curtain section and the united section to prevent folds from occurring in the blind section.

In addition, a flame retardant thread subjected to flame retardant processing is employed as the warp and woof for weaving the blind section, or the woven blind section is subjected to flame retardant processing to make the woven vertical blind safe against fire.

In addition, after the blind section is assembled, the curtain section adjacent to and coupled to the fabric louvers is folded and backstitched to make the curtain section with a smooth arc, thereby enhancing an aesthetic property of the blind.

DESCRIPTION OF DRAWINGS

FIGS. 16A, 16B, and 16C are cross-sectional views illustrating an exemplary blind section according to the present invention.

BEST MODE

The present invention relates to a vertical blind united by weaving and a method of fabricating the same, wherein a plurality of fabric louvers 20 each having a constant width are arranged at a regular interval in one surface of a curtain section 10 having a predetermined area resulting from a mesh structure, the curtain section 10 is united with the fabric louvers 20 by weaving along longitudinal edges of the fabric louvers 20, and upper ends of the fabric louvers 20 are applied to a typical vertical blind structure, so that lighting is adjusted by rotation of the fabric louvers and air ventilation through the curtain section 10 is facilitated.

The structure of the vertical blind and the method of fabricating the same according to the present invention will now be described, and the structure of the vertical blind united by weaving is first described as set forth below.

The vertical blind includes a blind section 50 composed of a curtain section 10 and fabric louvers 20 coupled to the curtain section 10 at a regular interval, and the blind section 50 is applied to a typical vertical blind structure. The vertical blind according to the present invention is implemented in accordance with first and second embodiments depending on the structure of the blind section 50 and is also implemented in accordance with a third embodiment by the process of fabricating the blind section. The blind section 50 of the first embodiment and the blind section 50 of the second embodiment will be sequentially described as follows.

Figure 1:
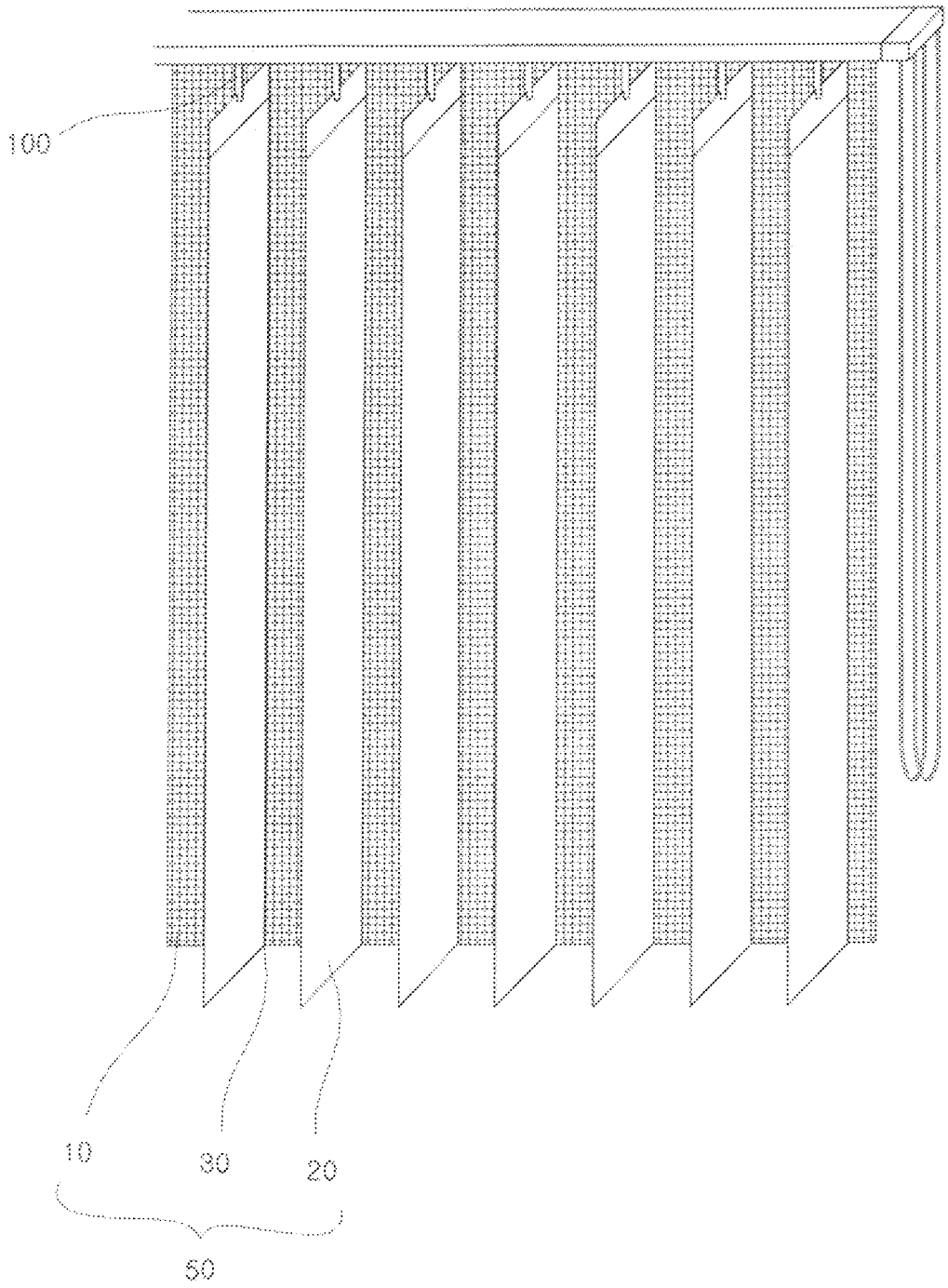
FIG. 1 is a perspective view illustrating a vertical blind according to a first embodiment of the present invention.
Figure 2:
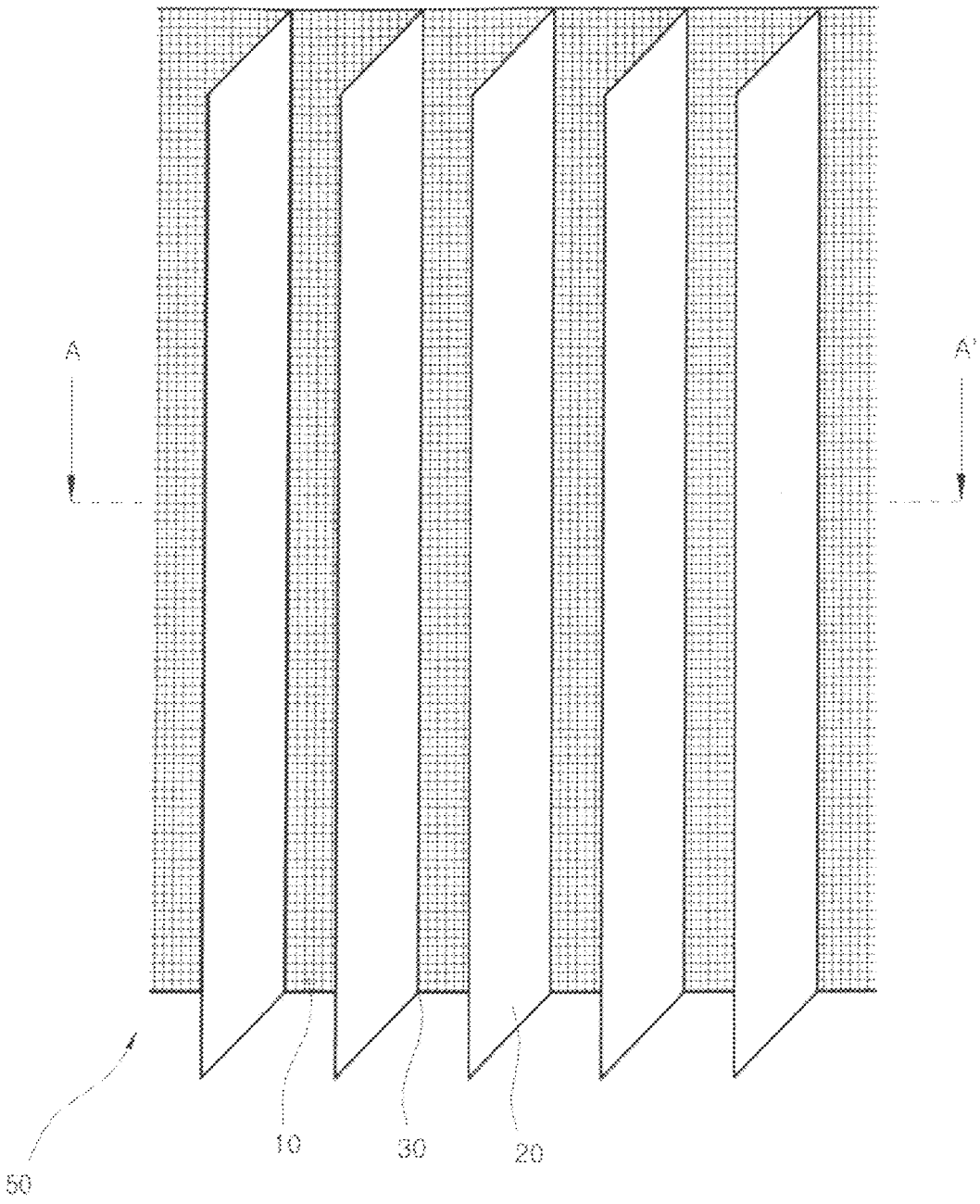
FIG. 2 is a perspective view illustrating a blind section included in a vertical blind according to the present invention.
Figure 3:
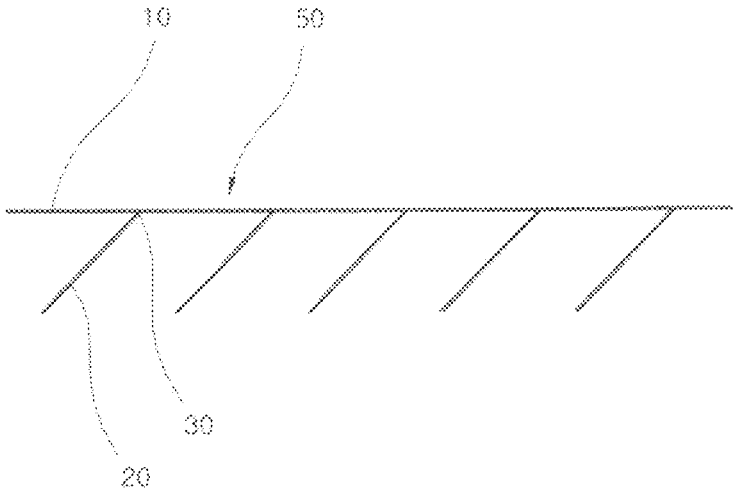
FIGS. 3A and 3B are partial cross-sectional views taken along the A-A' line of FIG. 2 according to first and second embodiments of the present invention, respectively.
Figure 3:
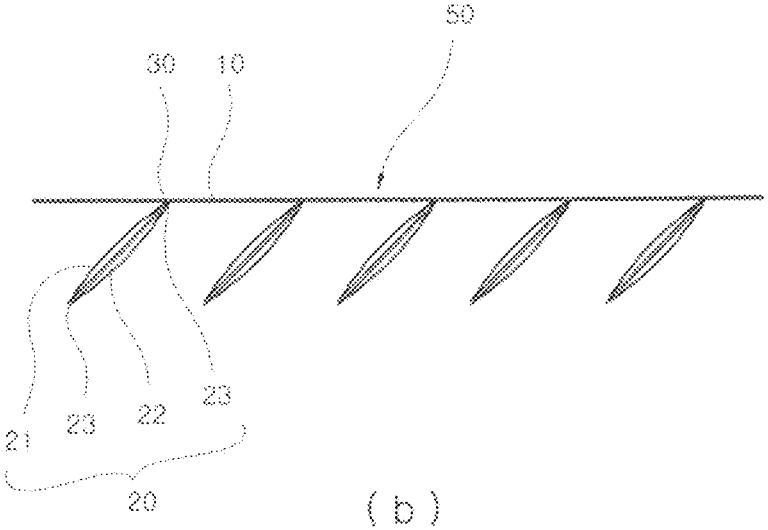

Referring to FIGS. 1 to 3 in connection with the structure of the blind section 50 according to the first embodiment, the blind section 50 according to the first embodiment has the curtain section 10 with a predetermined area and a plurality of fabric louvers 20 of a constant width arranged at a constant interval, wherein the fabric louvers 20 are arranged along the height direction of the curtain section 10, are united with the curtain section 10 along one edge of its longitudinal direction, and are fixed to the curtain section 10 at an interval corresponding to the width of the fabric louver 20 in the united structure as described above, thereby forming the blind section 50.

Figure 9:
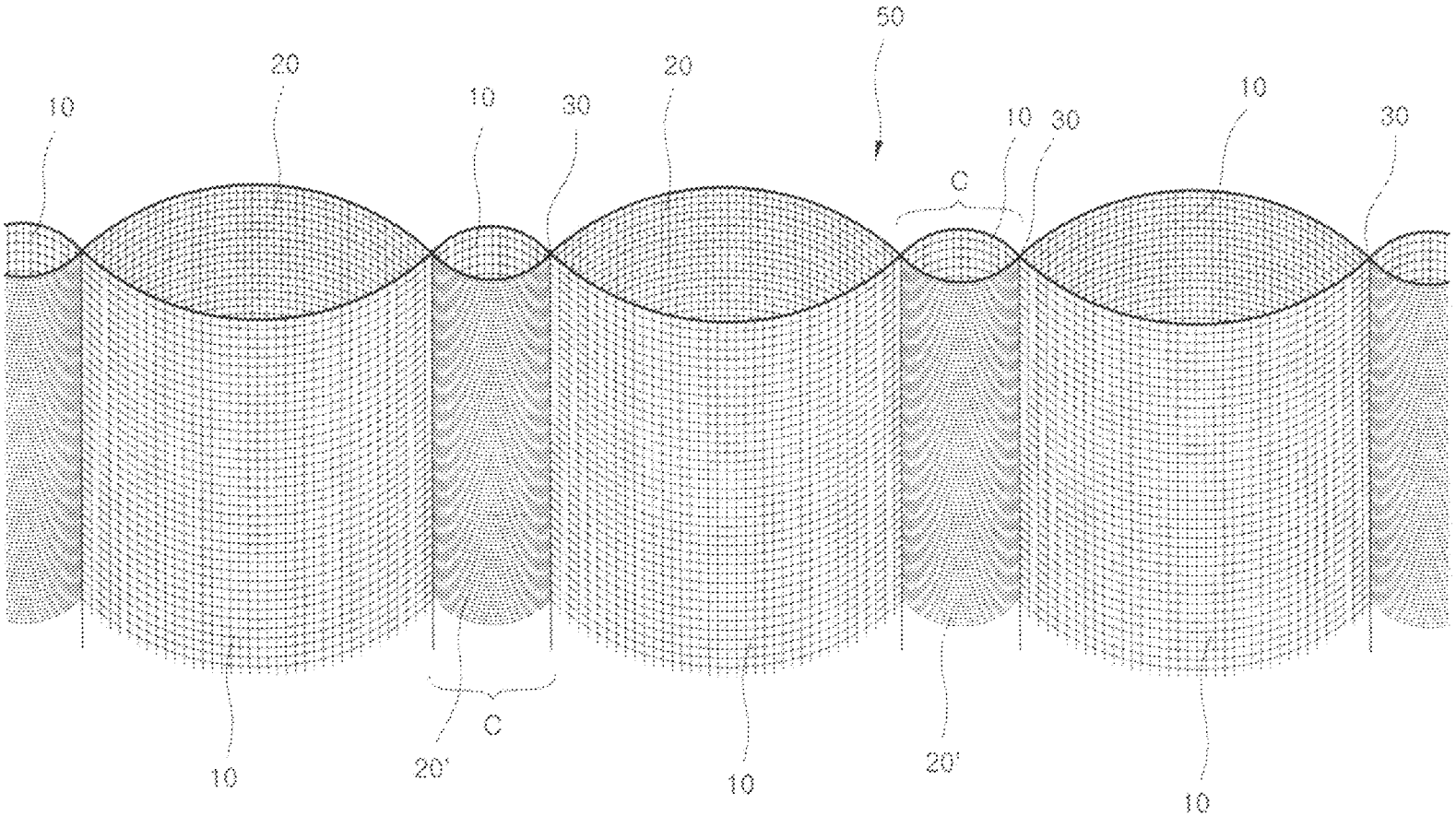
FIG. 9 is a perspective view illustrating a blind section having one-fold fabric louvers woven according to a third embodiment of the present invention.

In the meantime, the width of the fabric louver 20 may be the same as the interval between the fabric louvers 20 to have a straight line shape when seen in the cross-sectional view of the fabric louver 20 or may be larger than the interval between the fabric louvers 20 to allow the fabric louver 20 to overlap its adjacent fabric louver 20 as shown in FIGS. 3A and 9, thereby making it more easier to block light.

Figure 4:
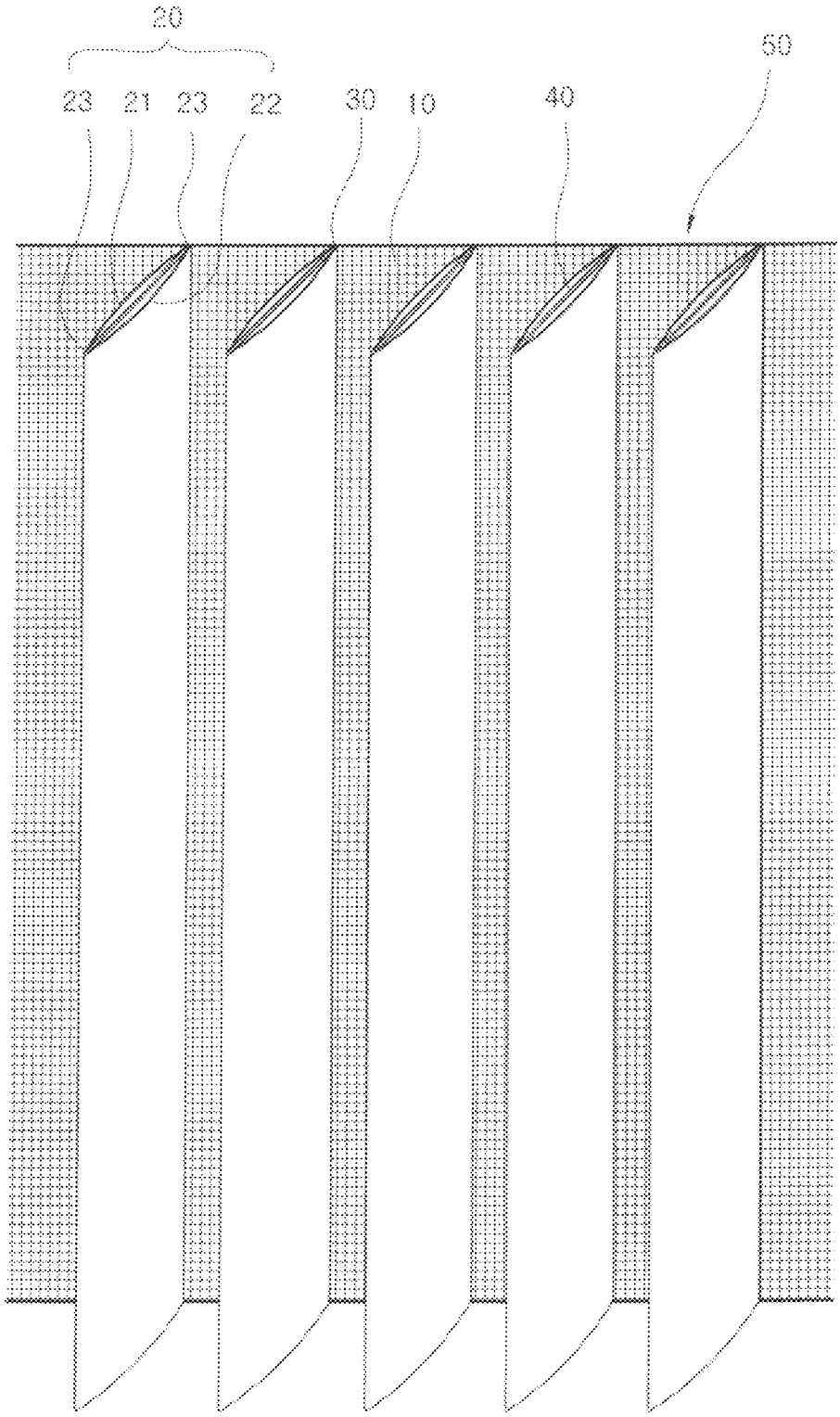
FIG. 4 is a perspective view illustrating a vertical blind including slats according to a second embodiment of the present invention.

In addition, referring to FIGS. 3 and 4 in connection with the structure of the blind section 50 according to the second embodiment, the blind section 50 according to the second embodiment has the same structure that the fabric louvers 20 are united with the curtain section 10 except that the fabric louver 20 has a two-fold hollow pocket structure, resulting in the blind section 50 having the cross-sectional structure as shown in FIG. 3B and having the cross-sectional structure as shown in FIG. 16A.

The blind section 50 is united by weaving using combination of warps and woofs, wherein the woofs are properly supplied to the respective parts of the blind section, however, a pattern of 12 warp strands is repeatedly used for weaving the curtain section 10 and three fabric louvers 20.

In other words, the pattern having the 12 warp strands is repeatedly woven per three fabric louvers 20 so that the warps are used over the curtain section 10, the fabric louvers 20 and the united sections 30.

In addition, the portion where the fabric louver 20 and the curtain section 10 are in contact each other is named the united section 30, the surface of the fabric louver 20 facing the curtain section 10 is named a back portion 22, the opposite surface of the fabric louver is named a front portion 21, and a portion where the front portion 21 and the back portion 22 are in contact with each other is named a coupled portion 23 in the blind section 50 according to the second embodiment. The 12 warps used for weaving the fabric louver 20, the curtain section 10 and the united section 30 according to the first and second embodiments are labeled A-L, and are denoted in the tables 1 and 2 below.

TABLE 1

| | | warp | | | | | | | | | | | |
|---|---|---|---|---|---|---|---|---|---|---|---|---|---|
| phase | Location | A | B | C | D | E | F | G | H | I | J | K | L |
| 1 | Curtain Section | ○ | ○ | ○ | ○ | ○ | ○ | ○ | ○ | | | | |
| | Fabric Louver | | | | | | | | | ○ | ○ | ○ | ○ |
| | United section | ○ | ○ | ○ | ○ | ○ | ○ | ○ | ○ | ○ | ○ | ○ | ○ |
| 2 | Curtain Section | | | | | ○ | ○ | ○ | ○ | ○ | ○ | ○ | ○ |
| | Fabric Louver | ○ | ○ | ○ | ○ | | | | | | | | |
| | United Section | ○ | ○ | ○ | ○ | ○ | ○ | ○ | ○ | ○ | ○ | ○ | ○ |
| 3 | Curtain Section | ○ | ○ | ○ | ○ | | | | | ○ | ○ | ○ | ○ |
| | Fabric Louver | | | | | ○ | ○ | ○ | ○ | | | | |
| | United section | ○ | ○ | ○ | ○ | ○ | ○ | ○ | ○ | ○ | ○ | ○ | ○ |

The blind section 50 according to the first or second embodiment is then applied to a typical vertical blind structure for fabricating the vertical blind. The typical vertical blind structure will now be described as follows. The typical vertical blind structure has carriers movable along the rail and two adjustment strings, wherein each of the carriers has a housing movable along the rail and a louver ring 100 rotatable with respect to the housing and one of the adjustment strings allows the housing to move along the rail to be collected at one side or both sides and the other thereof allows the louver ring 100 to be rotated.

In case of the blind section 50 according to the first embodiment in the typical vertical blind structure, the woven and united vertical blind is implemented as shown in FIG. 1 when one end of each of the fabric louvers 20 of the blind section 50 is fixed. In case of the blind section 50 according to the second embodiment, a reinforcement plate is inserted into each of the fabric louvers 20 to implement the woven and united vertical blind.

Figure 6:
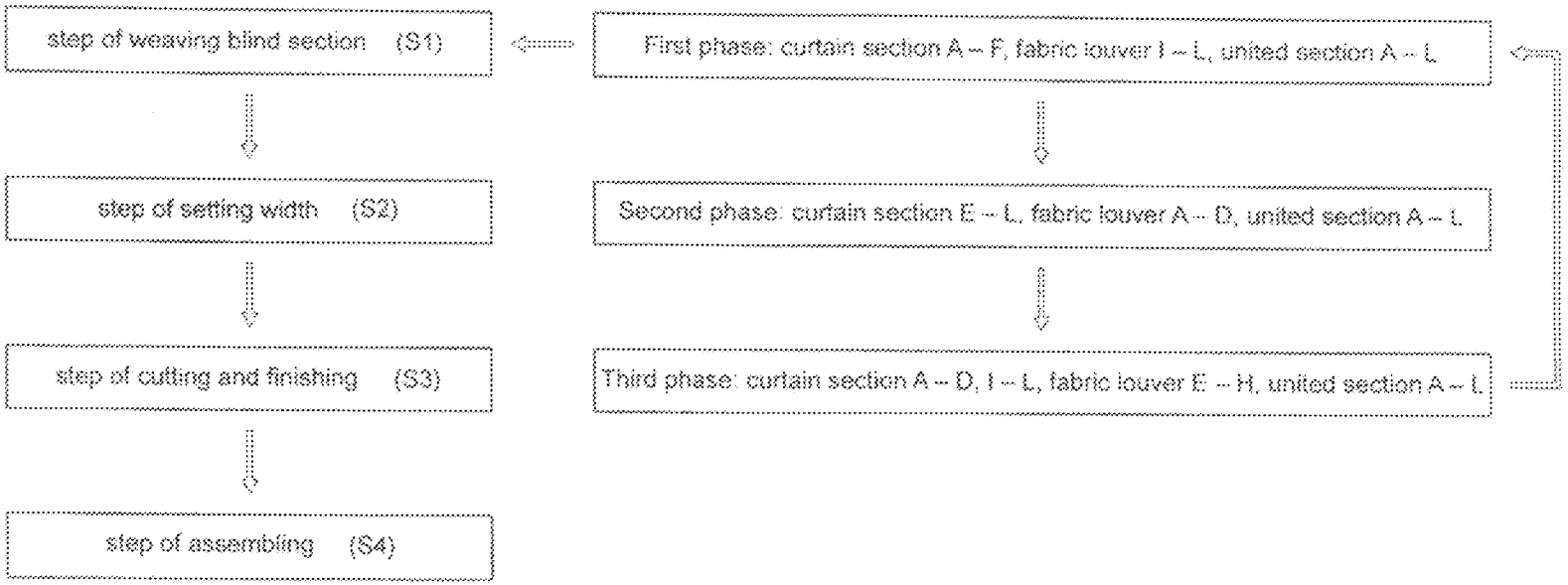
FIG. 6 is a process view illustrating steps of fabricating a vertical blind according to the present invention.

Next, a method of fabricating the vertical blind will now be described with reference to the process shown in FIG. 6. First, the step S1 of weaving the blind section will be described.

Referring to the table 1, it helps understand the steps which are also shown in the process view, and the phases correspond to a case that one fabric louver 20 is formed, so that three phases are repeated in total.

In the first phase, woofs are separately supplied at a side by the weaving device while 12 warps are repeatedly supplied, wherein warps of A, B, C, D, E, F, G, H among 12 warp strands are used in the curtain section 10, warps of I, J, K, L are used in the fabric louver 20, and warps of A, B, C, D, E, F, G, H are used in the united section 30, resulting in the dense blind section.

In the second phase, warps of E, F, G, H, I, J, K, L are used in the curtain section 10, warps of A, B, C, D are used in the fabric louver 20, and warps of A, B, C, D, E, F, G, H are used in the united section 30, resulting in the dense blind section.

In addition, in the third phase, warps of A, B, C, D, I, J, K, L are used in the curtain section 10, warps of E, F, G, H are used in the fabric louver 20, and warps of A, B, C, D, E, F, G, H are used in the united section 30, resulting in the dense blind section.

The warps are repeatedly woven over the first to third phases to allow the united sections 30 to form spaces between the curtain section 10 and the fabric louvers 20 as shown in FIG. 7A.

TABLE 2

| phase | Location | | warp A | B | C | D | E | F | G | H | I | J | K | L |
|---|---|---|---|---|---|---|---|---|---|---|---|---|---|---|
| 1 | Curtain section | | ○ | ○ | ○ | ○ | ○ | ○ | ○ | ○ | | | | |
| | Fabric louver | Front Portion | | | | | | | | | ○ | ○ | | |
| | | Back Portion | | | | | | | | | | | ○ | ○ |
| | | coupled portion | | | | | | | | | ○ | ○ | ○ | ○ |
| | United section | | ○ | ○ | ○ | ○ | ○ | ○ | ○ | ○ | ○ | ○ | ○ | ○ |
| 2 | Curtain section | | | | | | ○ | ○ | ○ | ○ | ○ | ○ | ○ | ○ |
| | Fabric Louver | Front Portion | ○ | ○ | | | | | | | | | | |
| | | Back Portion | | | ○ | ○ | | | | | | | | |
| | | coupled Portion | ○ | ○ | ○ | ○ | | | | | | | | |
| | United section | | ○ | ○ | ○ | ○ | ○ | ○ | ○ | ○ | ○ | ○ | ○ | ○ |
| 3 | Curtain section | | ○ | ○ | ○ | ○ | | | | | ○ | ○ | ○ | ○ |
| | Fabric Louver | Front Portion | | | | | ○ | ○ | | | | | | |
| | | Back Portion | | | | | | | ○ | ○ | | | | |
| | | coupled portion | | | | | ○ | ○ | ○ | ○ | | | | |
| | United section | | ○ | ○ | ○ | ○ | ○ | ○ | ○ | ○ | ○ | ○ | ○ | ○ |

In addition, weaving the blind section 50 according to the second embodiment will now be described. The warps of the fabric louvers 20 are classified into ones for the front portion 21 and ones for the back portion 22 in the weaving step according to the first embodiment, and the coupled portion 23 is specifically formed. This coupled portion 23 has the pattern of warps shown in the fabric louvers 20 of each phase of the blind section 50 according to the second embodiment, wherein warps of I and J are used for the front portion 21, warps of K and L are used for the back portion 22, and warps of I, J, K, L are used for the coupled portion 23 in the first phase.

Warps of A and B are used for the front portion 21, warps of C and D are used for the back portion 22, and warps of A, B, C, D are used for the coupled portion 23 in the second phase, and warps of E and F are used for the front portion 21, warps of G and H are used for the back portion 22, and warps of E, F, G, H are used for the coupled portion 23 in the third phase.

The first to third phases are also repeatedly carried out to form the blind section 50 according to the second embodiment. This blind section 50 forms spaces between the curtain section 10 and the fabric louvers 20, and each of the fabric louvers 20 also forms a space by means of the front portion 21, the back portion 22, the coupled portion 23 and the united section 30 as shown in FIG. 7B.

In the meantime, as shown in FIG. 3B, the coupled portion of the fabric louver 20 according to the second embodiment acts to couple the front portion 21 with the back portion 22 which are simultaneously woven. In particular, the outside coupled portion to be opened by cutting the fabric louver 20 must be woven whereas the coupled portion 23 coupled to the curtain section 10 is finished by the united section 30 so that it can be omitted as shown in FIG. 7B.

For reference, the 12 warps of A-L may be arranged in any order, which means that the warps need not to be sequentially arranged in an alphabetical order (i.e., the warps are not woven in the alphabetical order at the time of setting the warps in the weaving device). The warps are used to allow the curtain section 10, the fabric louver 20, and the united section 30 to be crossed and woven in accordance with the three phases as described above, resulting in the optimal cross-section of the blind section 50 without any waste.

Figure 8:
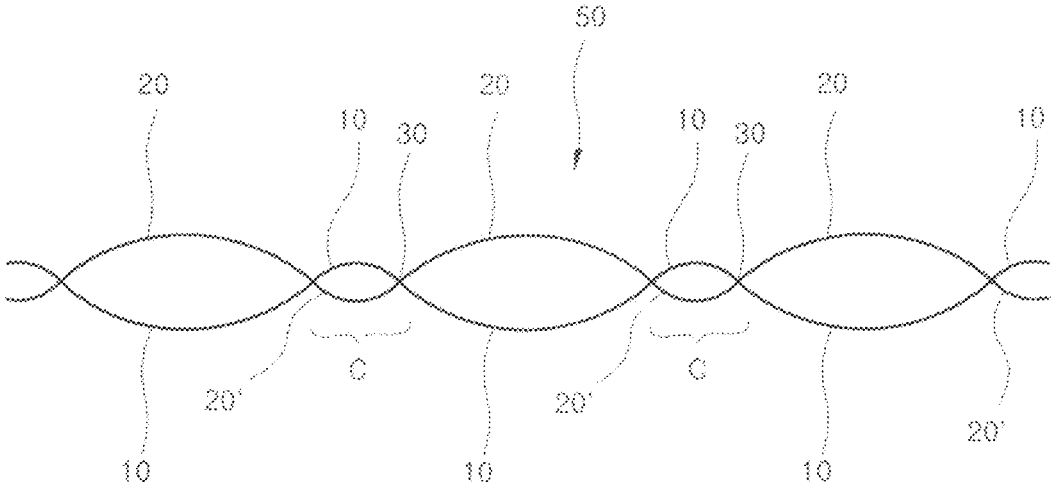
FIG. 8 is a cross-sectional view illustrating a blind section woven according to a third embodiment of the present invention.

In addition, the blind section 50 according to the third embodiment will be described with reference to FIGS. 8 to 12. The blind section 50 according to the third embodiment has the woven structure similar to the blind section 50 according to the first embodiment. That is, the curtain section 10 and the fabric louvers 20 are simultaneously woven with a constant width and then the united section 30 is repeatedly woven. The curtain section 10 and the fabric louvers 20 are supplied with woofs and warps to be woven with a constant width between the united section 30 and the next united section 30 as shown in FIGS. 8 and 9, and then the curtain section 10 is supplied with the woofs to be woven while the fabric louvers 20' are not supplied with the woofs, resulting in the cutting sections C where the warps are opened with a constant width in a row in one surface.

Figure 10:
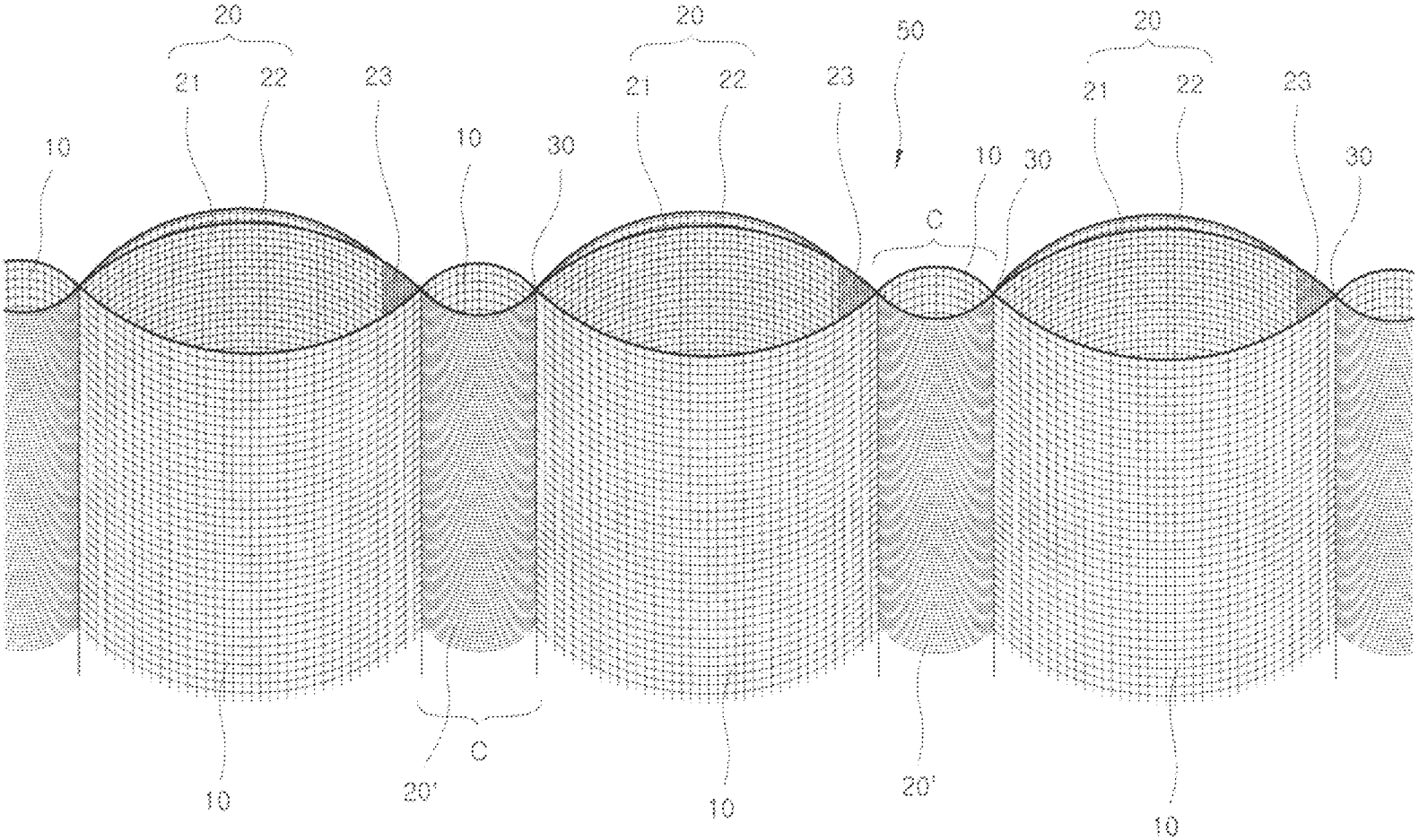
FIG. 10 is a perspective view illustrating a blind section having two-fold fabric louvers woven according to the third embodiment of the present invention.

In addition, referring the FIG. 10 in connection with the case of weaving the two-fold fabric louver 20 as done in the blind section 50 of the second embodiment, the curtain section 10 and the fabric louver 20, that is, the curtain section 10, the front portion 21, the back portion 22, and the coupled portion 23 are all supplied with separate warps and woofs to be woven, and then the curtain section 10 and the fabric louver 20' are woven. In particular, the curtain section 10 is supplied with warps and woofs to be woven, and at the same time, the woofs are not supplied after the coupled portion 23, resulting in the cutting sections C where the warps are opened with a constant width in the fabric louvers 20' coupled to the coupled portion 22.

Figure 11:
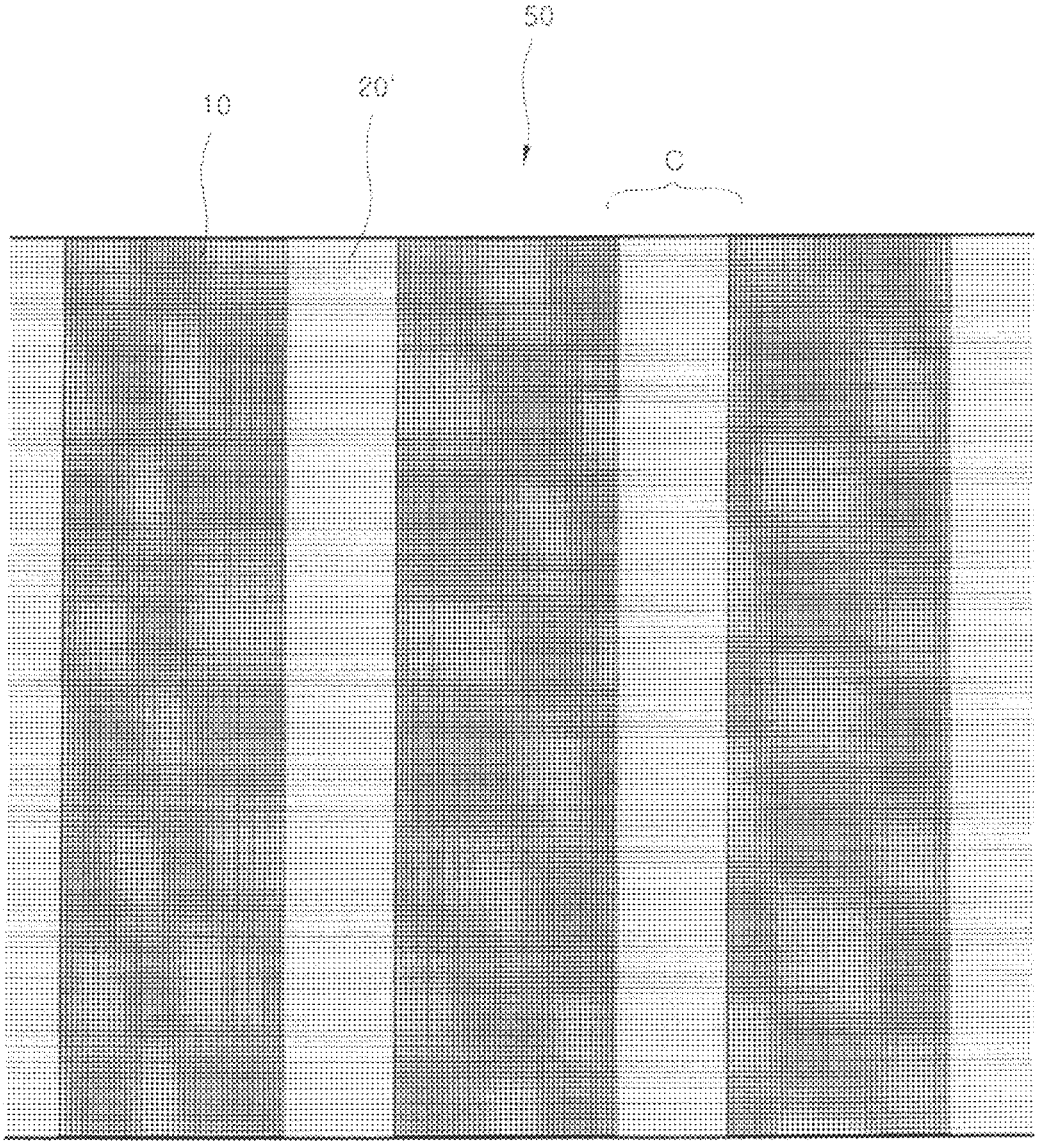
FIG. 11 is a plan view illustrating a blind section woven according to the third embodiment of the present invention.

In other words, the woven structure of the blind section 50 according to the third embodiment is as follows. The curtain section 10 and the fabric louvers 20 are simultaneously woven, the curtain section 10 is then woven while the fabric louver 20' is not supplied with the woofs to form the cutting section C where the warps are opened in the warp weaving direction, and then the united section 30 is woven. Only one surface of the woven blind section 50 has the opened warps in the cutting section C as shown in FIG. 11. Preferably, the surface where the warps of the cutting section C are opened acts to block light, and the fabric louver 20' is formed at the opposite side with respect to the curtain section 10 repeatedly resulting in the cross-sectional structure shown in FIG. 16B or the cross-sectional structure shown in FIG. 16C.

Accordingly, the structure of the blind section 50 according to the third embodiment facilitates shearing of the opened warps in the subsequent cutting and finishing step S3, which is thus faster and easier than the blind section 50 woven according to the first and second embodiments.

In addition, materials and thicknesses of the warps and woofs are as follows.

Each warp is formed of a synthetic fiber thread and has a thickness of 50-150 D (D denotes denier).

In addition, the woof of the curtain section 10 is formed of a low-melting fiber thread and has a thickness of 50-150 D.

The woof used for forming the fabric louver 20 is composed of two threads, that is, a synthetic fiber thread and a low-melting fiber thread. The synthetic fiber thread has a thickness of 270-350 D, and the low-melting fiber thread has a thickness of 50-150 D.

In addition, the woof used for forming the united section 30 is composed of two threads, that is, a synthetic fiber thread and a low-melting fiber thread. The synthetic fiber thread has a thickness of 280-350 D, and the low-melting fiber thread has a thickness of 50-150 D. The warp and woof applied to the cutting section C of the third embodiment are the same as the warp and woof used for forming the curtain section 10 and the fabric louver 20, the thicknesses mentioned above are just examples and may be changed.

Thicknesses and materials of the warp and woof of the blind section 50 are summarized in the table 3 below.

TABLE 3

| Name | | Material | thickness(D) | Note |
|---|---|---|---|---|
| Curtain Section | warp | Synthetic fiber thread | 50~150 | |
| | woof | Low-melting fiber thread | 50~150 | |
| Fabric louver | warp | Synthetic fiber thread | 50~150 | |
| | woof | Synthetic fiber thread | 270~350 | composed of two threads |
| | | Low-melting fiber thread | 50~150 | |
| United section | warp | Synthetic fiber thread | 50~150 | |
| | woof | Synthetic fiber thread | 208~350 | composed of two threads |
| | | Low-melting fiber thread | 50~150 | |

In addition, the low-melting fiber thread used for the woof of the blind section 50 has a melting point of 170-220□. This is because that the low-melting fiber is bonded with the warp such as a synthetic fiber thread at its melting point due to its characteristic to maintain the respective woven structures and is not deformed even when an external force is applied thereto, so that the blind section 50 woven as described above can maintain its shape by means of melting bond when heat of 170 to 220□ is applied thereto by a separate Tenter in the subsequent width setting step S2. A pure low-melting fiber thread, a low-melting fiber thread composed of a synthetic fiber yarn at its cross-sectional center and an outside low-melting fiber, or a low-melting fiber thread composed of a low-melting fiber thread and a synthetic fiber yarn which are twisted together, may be employed as the low-melting fiber thread mentioned above. In other words, any type of the low-melting fiber thread may be employed.

In addition, woofs included in the curtain section 10 and the united section 30 are interlaced (covered) with a rubber thread to prevent folds from occurring after weaving.

Preferably, the curtain section 10 has a mesh structure and the fabric louvers 20 are basically densely woven to have a structure of blocking sunlight. As done in the fabric louver 20 according to the second embodiment, the fabric louver 20 has a pocket structure and a slat 40 is inserted into the fabric louver 20, so that the structure of the fabric louver 20 according to the second embodiment allows both sunlight blocking and mesh structures to be implemented, and the fabric louver 20 according to the first embodiment must have the sunlight blocking structure.

For reference, the blind section 50 is made to be safe against fire. To this end, threads used for the warps and woofs of the blind section 50 have a flame retardant property, or the woven blind sections 50 are put into a flame retardant liquid prior to the width setting step S2.

In the subsequent width setting step S2, the blind sections 50 are made to pass through the tenter (a device that supports both edges of the texture or the like, moves the texture while applying heat thereto, makes its width even and arranges the width while smoothing out the texture) to arrange the width (at this time, the tenter typically carries out cutting in the width direction while arranging the width). Constitutional components of the blind section 50 are fixed by means of melting-bond of the warp and woof properties resulting from the heat generating in the tenter.

Figure 7:
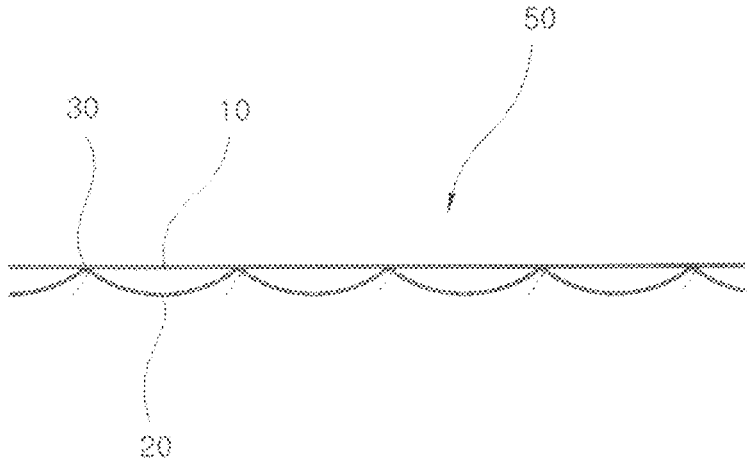
FIGS. 7A and 7B are cross-sectional views illustrating blind sections woven according to first and second embodiments of the present invention, respectively.
Figure 7:
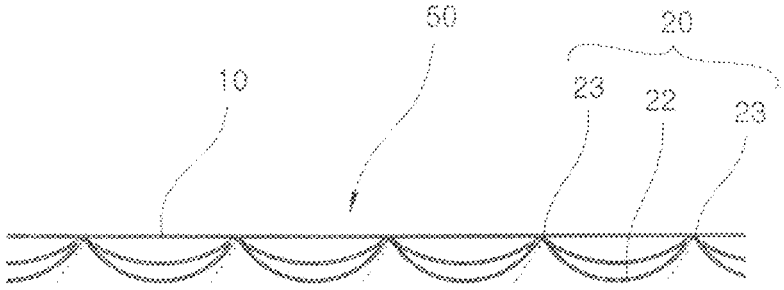

In the subsequent cutting and finishing step S3, the blind section 50 whose width is set is cut to a desired height, and the blind section is cut along the dotted line shown in FIG. 7, that is, the portion where one side of the fabric louver 20 is closed, so that the blind sections 50 are opened along the longitudinal direction of one side of the fabric louvers 20 and each edge of the blind sections is finished to prevent the edge from being raveled.

Cutting the one side of the fabric louver 20 of the blind section 50 will now be described. Cutting is carried out between the united section 30 and the fabric louver 20 along one side edge of each of the fabric louvers 20 in the case of the blind section 50 according to the first embodiment, however, cutting is carried out between the coupled portion 23 and the united section 30 along one side edge of each of the fabric louvers 20 in the case of the blind section 50 according to the second embodiment, thereby making one end of each of the fabric louvers 20 opened.

Figure 12:
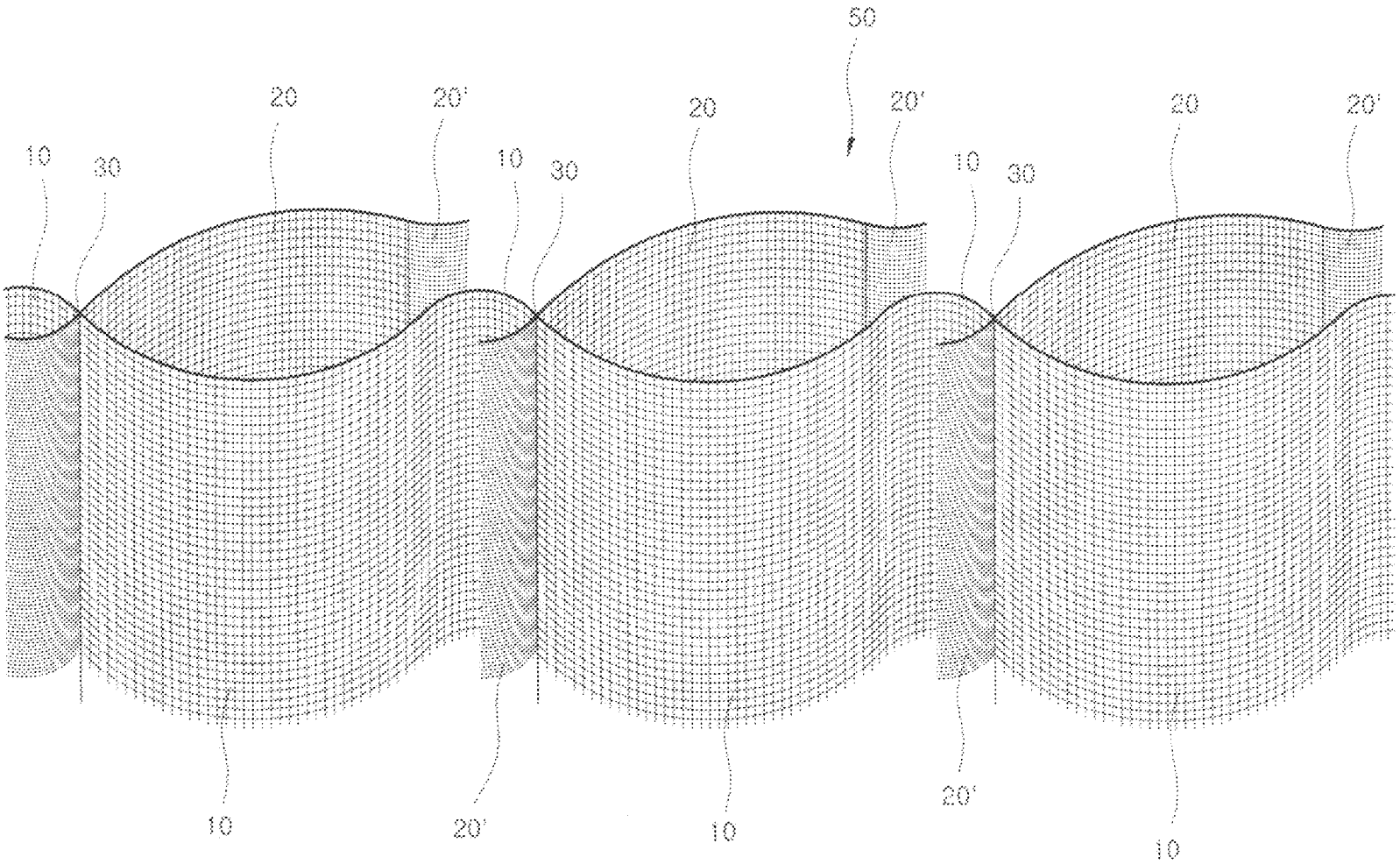
FIG. 12 is a perspective view of shearing the woven blind section according to the third embodiment of the present invention.

In addition, the cutting step according to the third embodiment fixes the blind section 50 to make the warps opened in the cutting section and removes the warps of the fabric louver 20' opened in the cutting section C by cutting. In particular, as shown in FIG. 12, middle portions of the opened warps of the fabric louvers 20' in the cutting section C are cut, a wind is blown through the blind section 50, and the opened warps in the cutting section are cut. At this time, a shearing machine is used to shear (cut) the opened warps in the cutting section C so that the warps are removed by shearing. Accordingly, the fabric louvers 20 are fixed along the united sections 30 and the opposite sides thereof are spaced and opened.

Accordingly, in the blind section 50 of the third embodiment, the width of the fabric louver 20 is shorter than a distance between adjacent fabric louvers 20, so that the curtain section 10 forms a smooth curve (arc) when the blind is assembled.

In the meantime, the curtain section 10 between the fabric louvers 20 forms the curve after the blind sections 50 are assembled to be the vertical blind. The curve of the curtain section 10 preferably has a smooth arc shape to be protruded in the opposite side of the fabric louvers 20, however, the curtain section 10 may have the S-shaped curve due to the weaving process and the weaving direction of the blind sections 50.

Figure 13:
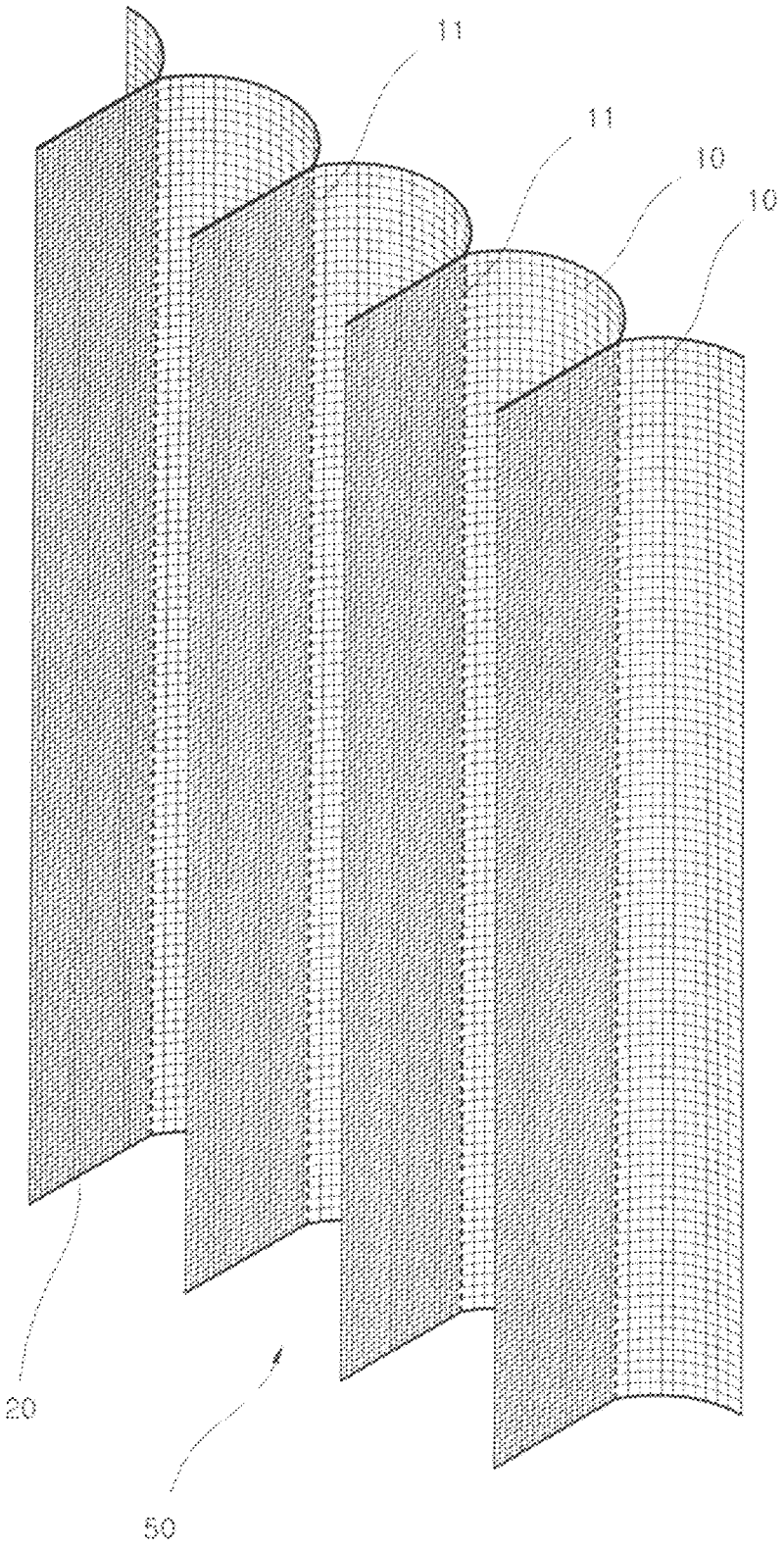
FIG. 13 is a perspective view illustrating a blind section with backstitching portions formed according to the present invention.
Figure 14:
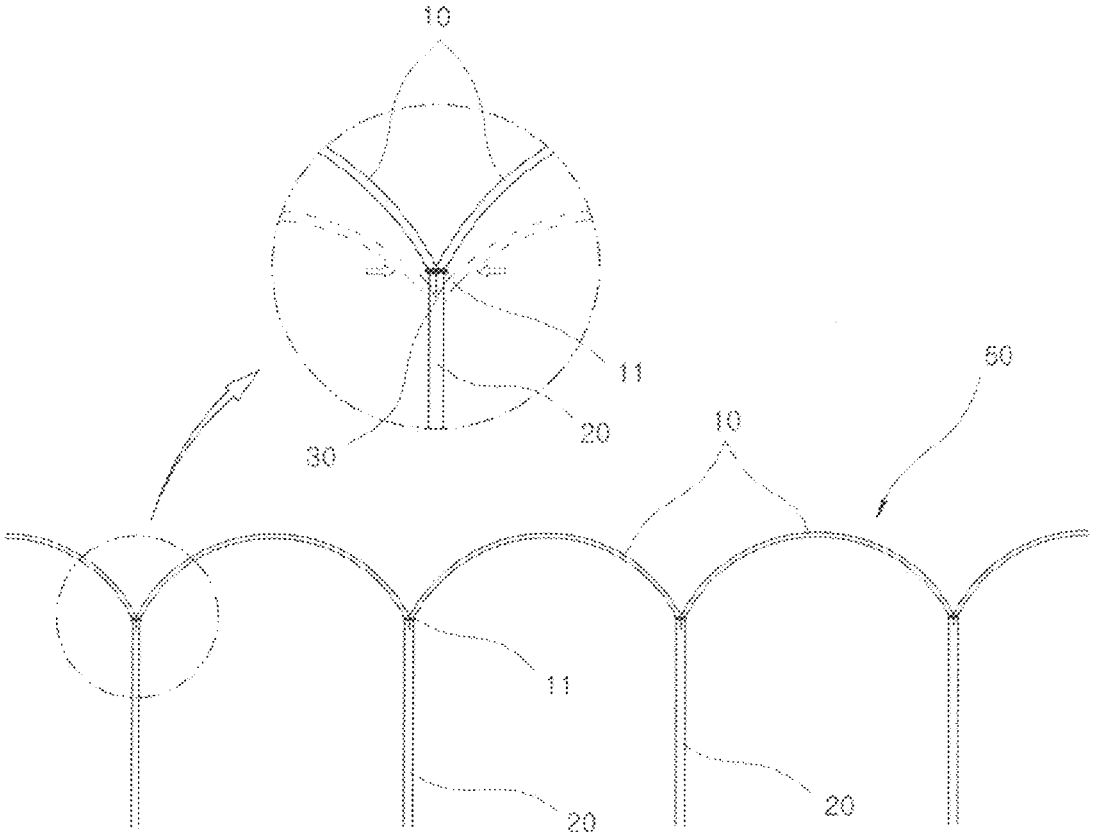
FIG. 14 is a plan view and partially enlarged view illustrating a blind section with backstitching portions formed according to the present invention.
Figure 15:
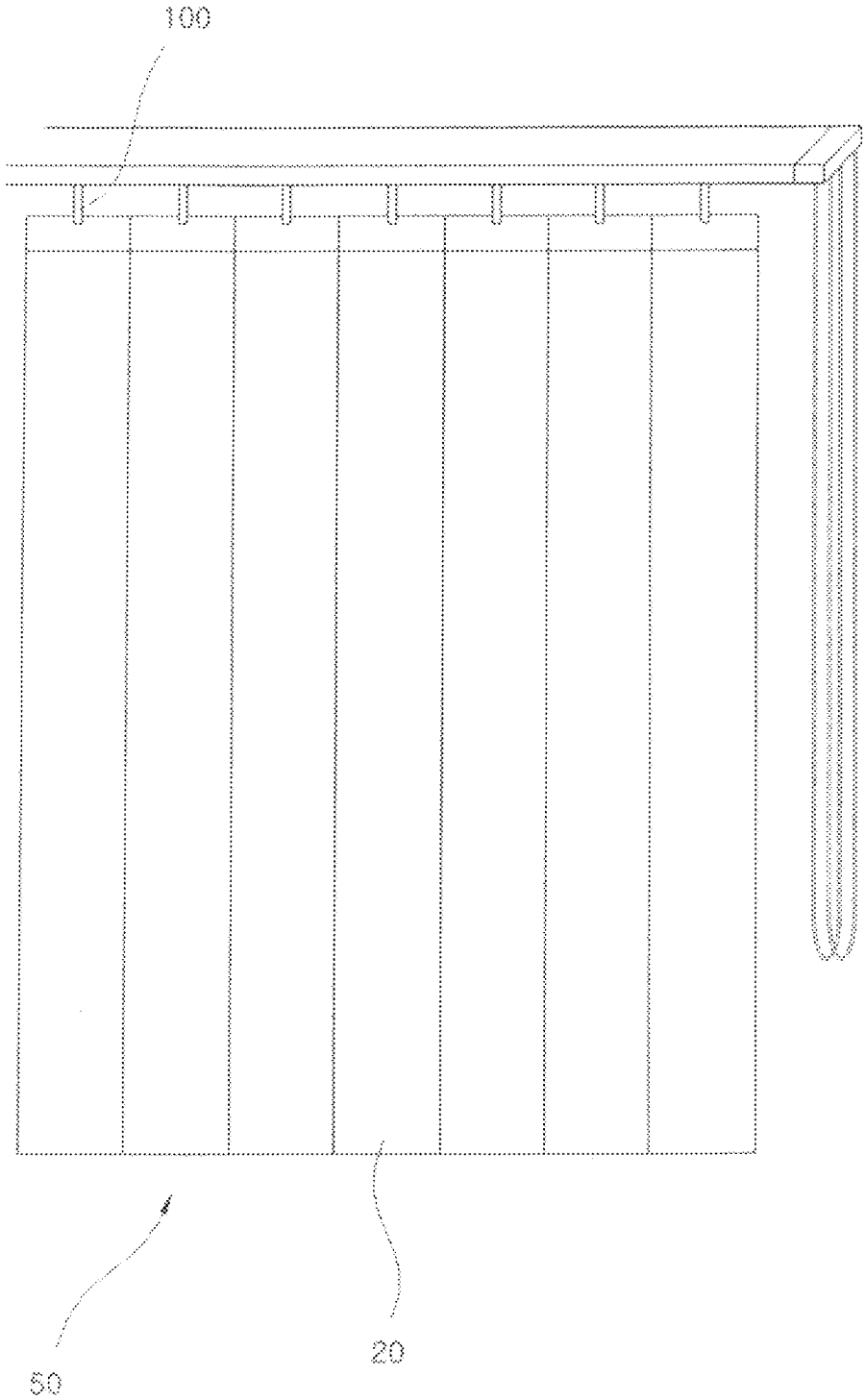
FIG. 15 is a front view illustrating a vertical blind according to the present invention.
Figure 10:
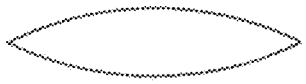
Figure 10:
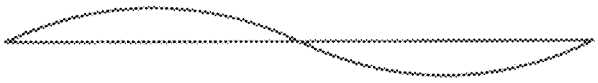
Figure 10:
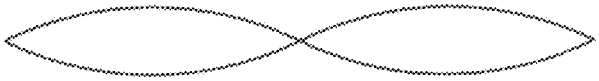

Accordingly, in the cutting and finishing step S3, when the backstitching portions 11 are formed at positions between the fabric louvers 20 and the curtain section 10 along the curtain section 10 as shown in FIGS. 13 and 14, the backstitching portions 11 make the curtain section 10 directed outward so that the curtain section 10 has the smooth arc shape even after the blind sections 50 are assembled to be the vertical blind.

In addition, edge-finishing the blind section 50 is not required, since the threads are not raveled by means of the melting-bond, however, portions of the blind section that are not arranged may be arranged to be finished or other textures may wrap around the edge of the blind section 50 to be fixed (bias processing).

In the subsequent assembly step S4, the resultant blind sections 50 are assembled with a typical vertical blind structure to complete the vertical blind. In particular, the louver rings 100 are fixed to one side of each of the fabric louvers 20 of the blind sections 50, resulting in the vertical blind.

Figure 5:
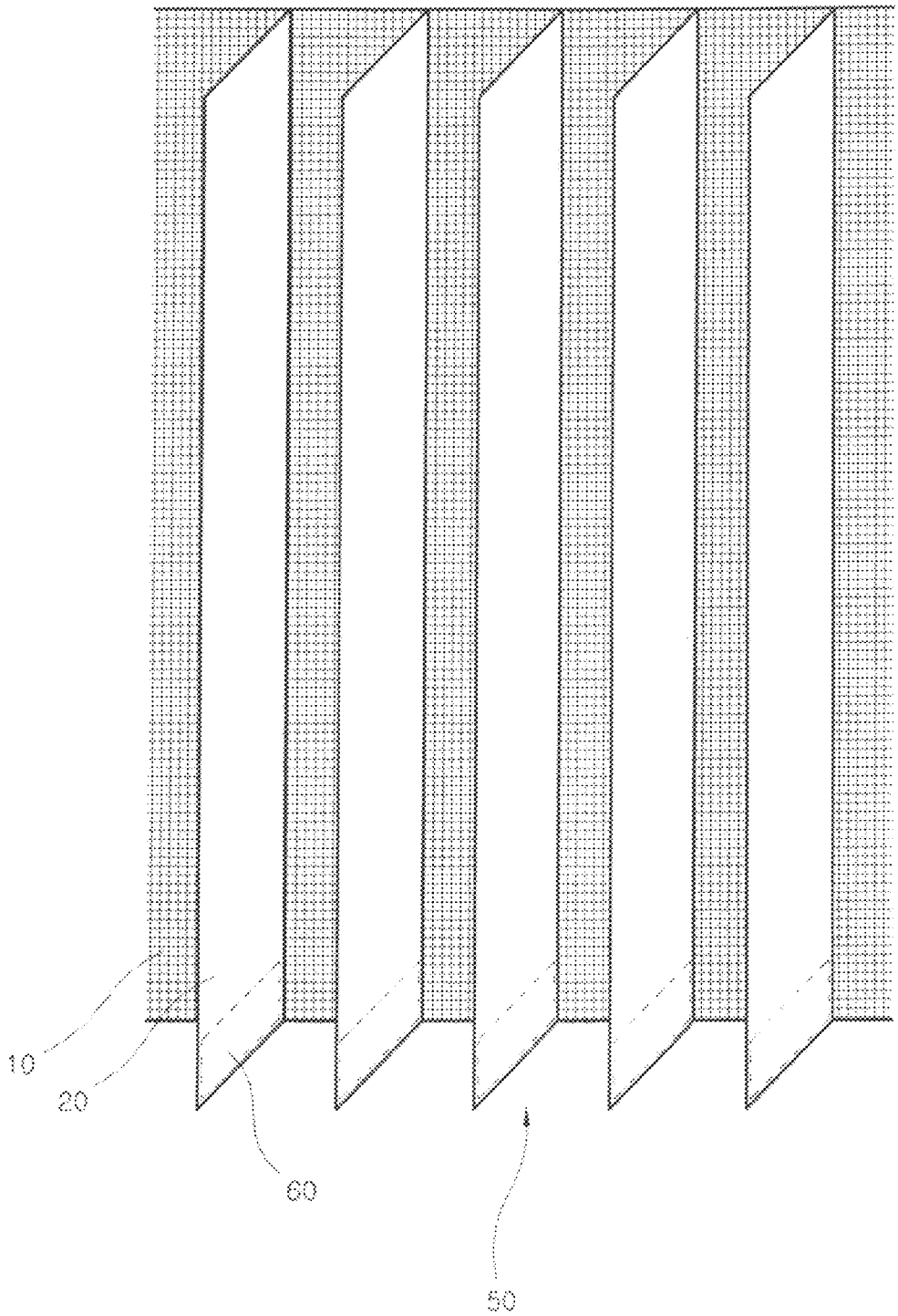
FIG. 5 is a perspective view illustrating weights included in a vertical blind according to the present invention.

In addition, in the assembly step S4, a weight 60 is fixed to the other end of the fixed fabric louver 20 after the louver ring 100 is fixed as shown in FIG. 5, so that the fabric louver 20 is prevented from being shaken.

In addition, when the blind section 50 according to the second embodiment is applied to the assembly step S4, as shown in FIGS. 4 and 7B, a panel-type slat 40 is put into the fabric louver 20 to block the lower end or both ends, and the slat 40 may be formed of any material such as synthetic resin, wood, metal or the like. The surface of the slat 40 is made to be completely adhered to the inner surface of the fabric louver 20 so that the fabric louver with the slat 40 inserted has a planar shape.

The vertical blind configured as described above is usually fixed to a window. In order to block light, as shown in FIG. 14, the fabric louvers 20 are made to be flat as done in the curtain section 10 to completely block light. When the fabric louvers 20 are rotated by 90 degrees while light is completely blocked, an outer view can be obtained and air can be ventilated while light is partially blocked by the curtain section 10. At this time, when the fabric louvers 20 are moved toward one side or both sides, light can be completely taken in.

According to the vertical blind configured as described above, the rotation angle of the fabric louver can be adjusted to adjust lighting, the curtain section 10 allows light to be blocked while allowing air to be ventilated, the blind sections 50 are united so that the fabric louvers 20 are not twisted and management there of is facilitated.

Further, pictures or characters may be formed in the fabric louvers 20 to enhance an aesthetic property and provide information.

The invention claimed is:

1. A vertical blind having a vertical blind structure, comprising:

a curtain section having a predetermined area resulting from a mesh structure; and a plurality of fabric louvers united with the curtain section and which are disposable toward or away from the curtain section so as to define respective closed and open positions, each of the fabric louvers having a same height as the curtain section and having a predetermined width for blocking light, wherein the fabric louvers are arranged along a width direction of the curtain section while each of the fabric louvers is united with the curtain section along one edge of a longitudinal direction of the curtain section to form a united section for each of the fabric louvers and the curtain section, the curtain section and the fabric louvers are united by weaving to form a blind section that is subjected to flame retardant processing, each upper end of the fabric louvers of the blind section is fixed to the vertical blind structure, and a pattern of twelve warp strands is repeatedly woven with the curtain section and one or more sets of only three fabric louvers so as to be woven throughout the united section of each of said curtain section and said one or more sets of only three fabric louvers, and a cross-section of the fabric louver has a two-fold hollow pocket structure, a lower end of the fabric louver is closed, and a slat is put into the fabric louver to facilitate maintaining a shape of the fabric louver, said two-fold hollow pocket structure defining a fabric louver front portion distal to the curtain section, a fabric louver back portion proximal to the curtain section and a fabric louver coupled portion coupling the front and back fabric louver portions together so that the fabric louver coupled portion is integrated with the curtain section at a respective united section, united sections between successive pairs of the fabric louvers being directly adjacent to each other when the plurality of fabric louvers are disposed toward the curtain section, and each fabric louver front portion and back portion being arcuately shaped so that said fabric louver back portion is spaced from the curtain section when the fabric louvers are disposed toward the curtain section.

2. The vertical blind of claim 1, wherein a rubber thread is interlaced with woofs of the curtain section and the united section to prevent folds from occurring in the blind section.

* * * * *